US010639670B2

(12) United States Patent
Sichien et al.

(10) Patent No.: US 10,639,670 B2
(45) Date of Patent: May 5, 2020

(54) CAULKING GUN

(71) Applicant: Altachem N.V., Harelbeke (BE)

(72) Inventors: Lieven Sichien, Uitbergen (BE); Jean-Marie Poppe, Heule (BE)

(73) Assignee: Altachem N.V., Harelbeke (BE)

( * ) Notice: Subject to any disclaimer, the term of this patent is extended or adjusted under 35 U.S.C. 154(b) by 0 days.

(21) Appl. No.: 16/334,797

(22) PCT Filed: Sep. 21, 2017

(86) PCT No.: PCT/EP2017/073876
§ 371 (c)(1),
(2) Date: Mar. 20, 2019

(87) PCT Pub. No.: WO2018/055024
PCT Pub. Date: Mar. 29, 2018

(65) Prior Publication Data

US 2019/0232332 A1 Aug. 1, 2019

(30) Foreign Application Priority Data

Sep. 21, 2016 (BE) ..... 2016/0150

(51) Int. Cl.
*B05C 17/01* (2006.01)
*B05C 17/005* (2006.01)

(52) U.S. Cl.
CPC .... *B05C 17/0123* (2013.01); *B05C 17/00596* (2013.01)

(58) Field of Classification Search
CPC ..... B05C 117/0123; B05C 117/00596; B05C 117/0126

(Continued)

(56) References Cited

U.S. PATENT DOCUMENTS 2,582,156 A * 1/1952 Peterson ..... B05C 17/0123 222/327
4,273,269 A * 6/1981 Davis, Jr. ..... B05C 17/012 222/326

(Continued)

FOREIGN PATENT DOCUMENTS

EP 1 892 045 A2 2/2008
EP 2 954 959 A1 12/2015

OTHER PUBLICATIONS

Notification of Transmittal of the International Search Report and the Written Opinion of the International Preliminary Searching Authority of PCT/EP2017/073876, dated Oct. 24, 2017, along with International Search Report and Written Opinion of the International Searching Authority.

(Continued)

*Primary Examiner* — Lien M Ngo
(74) *Attorney, Agent, or Firm* — Collard & Roe, P.C.

(57) ABSTRACT

A caulking gun for dispensing viscous material does not have any freeloop. A brake device is in the first and in the second position inclined relative to the axis of the push rod and a release device pushes the brake device in a third, essentially perpendicular position relative to the axis of the push rod in order to disengage the push rod from the brake device for pulling back the push rod and for acting simultaneously on the push device in order to disengage the push rod. Because the brake device is inclined in the first and in the second position due to the action of a spring acting on one end of the brake device and clamps the rod so that any freeloop (because the brake device does not clamp the rod in the upright position) is avoided.

9 Claims, 12 Drawing Sheets

Figure 1:
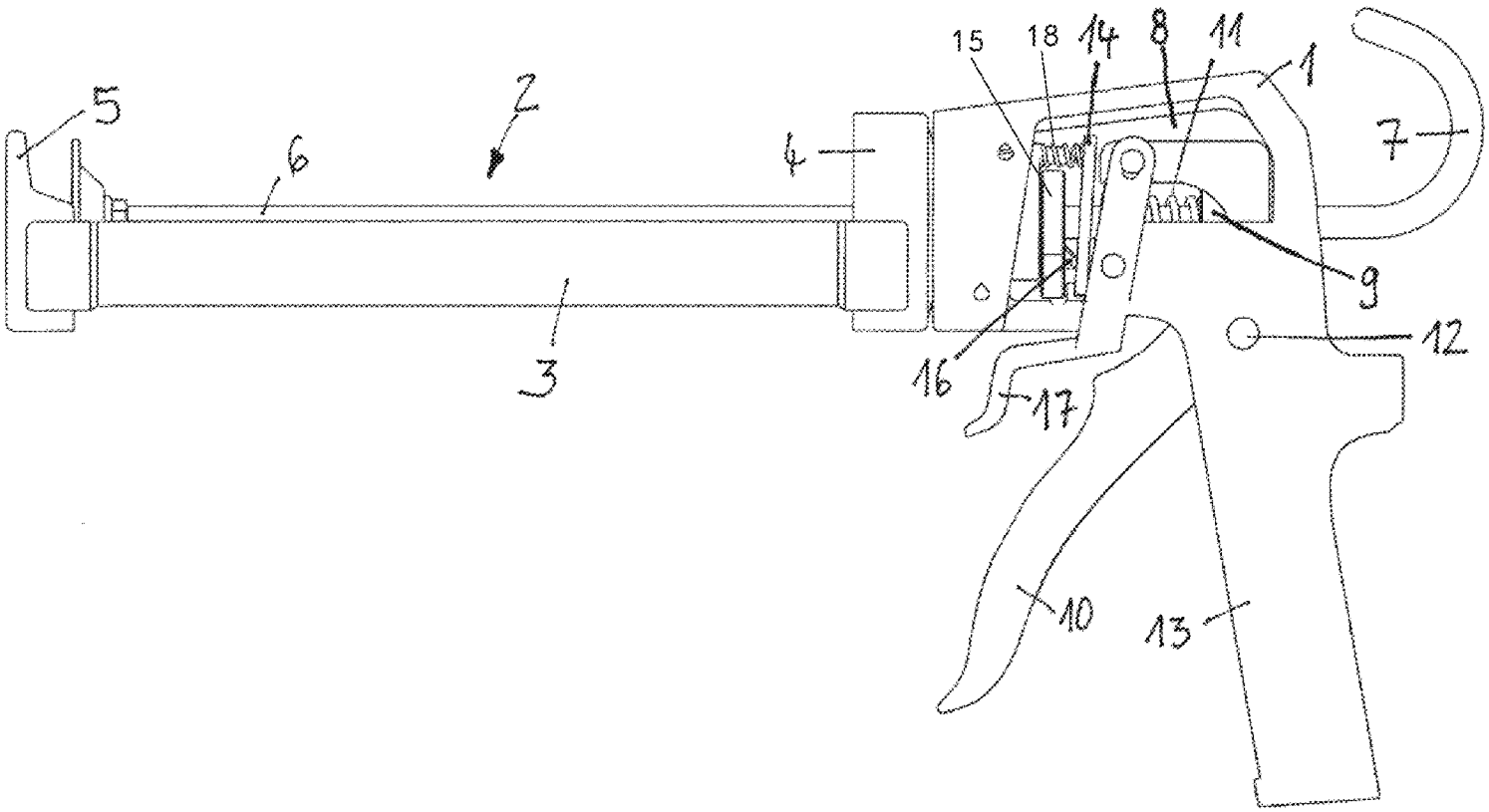

(58) Field of Classification Search
USPC .... 222/319, 391, 325–327, 386, 383.5, 309, 222/153.01, 153.13; 74/141.5, 169, 148, 74/531
See application file for complete search history.

(56) References Cited

U.S. PATENT DOCUMENTS

| | | | | |
|---|---|---|---|---|
| 6,691,899 | B2 * | 2/2004 | Sung | B05C 17/01 222/391 |
| 7,011,238 | B1 * | 3/2006 | Sung | B05C 17/0123 222/391 |
| 7,032,785 | B1 * | 4/2006 | Huang | B05C 17/0123 222/145.1 |
| 10,016,781 | B2 * | 7/2018 | Poppe | B05C 17/0126 |
| 2008/0047983 | A1 * | 2/2008 | Beckett | B05C 17/01 222/391 |
| 2009/0218372 | A1 * | 9/2009 | De Man | B05C 17/00576 222/391 |
| 2010/0237105 | A1 * | 9/2010 | Zagone | B05C 17/0126 222/391 |
| 2012/0211527 | A1 | 8/2012 | Strobel-Schmidt et al. | |
| 2013/0161360 | A1 * | 6/2013 | Marsden | B65D 83/0033 222/391 |

OTHER PUBLICATIONS

International Preliminary Report on Patentability of PCT/EP2017/073876, dated Jan. 4, 2019.
Written Opinion of the International Preliminary Searching Authority of PCT/EP2017/073876, dated Sep. 3, 2018.

* cited by examiner

CAULKING GUN

CROSS REFERENCE TO RELATED APPLICATIONS

This application is the National Stage of PCT/EP2017/073876 filed on Sep. 21, 2017, which claims priority under 35 U.S.C. § 119 of Belgium Application No. 2016/0150 filed on Sep. 21, 2016, the disclosure of which is incorporated by reference. The international application under PCT article 21(2) was published in English.

The present invention relates to a caulking gun for dispensing viscous material comprising a stock, a cartridge keep, a push rod longitudinally moveably mounted in the stock provided at its one end with a plunger which engages the piston of a cartridge placed in the cartridge keep, push means for engaging the push rod to advance it, the push means being pivotably held between the flanks on a trigger and being biased rearwards into an engaged attitude with the push rod by means of a spring, the trigger being coupled to the push means, brake means hinged to the stock and provided with a clearance hole for engaging the push rod such that the push rod is moveable in a direction advancing the push rod towards the cartridge and is held in a direction retreating the push rod from the cartridge, which brake means are arranged to travel to a first position relative to the stock as the push rod advances and to a second position as the push rod retreats thereby defining the retreat of the push rod, wherein the brake means are in the first and in the second position inclined relative to the axis of the push rod and that release means are provided for pushing the brake means in a third, essentially perpendicular position relative to the axis of the push rod in order to disengage the push rod from the brake means for pulling back the push rod and for acting simultaneously on the push means in order to disengage the push rod, and adjusting means arranged for varying the retreat of the push rod.

Viscous material, such as mastic caulking material or sealants, is commonly supplied in plastic cartridges having a discharge nozzle. The cartridge can be mounted in a caulking gun.

An example of such a caulking gun is described in EP 1 892 045 A2. It comprises a stock supporting a push rod which is advanceable along a keep in which a cartridge of a material can be mounted. The rod is advanced by means of a catch plate and a locking plate prevents the rod retreating with the catch plate. The locking plate is carried by the rod between a first and a second position so that it acts as a lost motion brake once force is removed from the trigger in one configuration of the dispensing gun, taking the dispensing force off the cartridge to prevent leaking when the trigger is not depressed. In an alternative configuration, the lost motion is reduced, for example to zero, to allow a continuous dispensing action by maintaining the pressure in the cartridge using a pumping action of the trigger.

According to the prior art, the catch member or catch plate is at the start in an upright released position so that there is some freeloop. Once the trigger is activated, the catch member passed from this upright released position into an oblique engaged position in which it clamps on the rod.

EP 2 954 959 A1 describes a caulking gun for dispensing viscous materials with at least two different levels of retreat of the push rod giving the user easily a visual feedback of the chosen retreat of the push rod. Retreat adjusting means are configured as a rotatable wheel with a slope, the rotatable wheel being fixed on the push rod between the stock and the brake means, the distance between the highest point of the slope and the brake means defining the retreat of the push rod.

U.S. Pat. No. 7,011,238 B1 describes a caulk dispensing gun for dispensing a viscous material received in a cartridge, including a stock having a piston rod, an actuating plate having an aperture for receiving the piston rod, and a trigger pivotally secured to the stock and having an actuating pin for engaging with the actuating plate.

The objective of the present invention is to provide a caulking gun which does not have any freeloop.

This objective is achieved in that the release means are configured as a lever which is coupled to a back part extending over the spring means and ending behind the push means, which when it is activated pushes one end of the brake means from the inclined position to the essentially perpendicular position in which the push rod can be pulled back and acts simultaneously on the push means in order to disengage the push rod, wherein the adjusting means, the brake means and the release means are arranged in the aperture of the stock above the trigger.

Due to the fact that the brake means are inclined in the first and in the second position (due e.g. to the action of spring means acting on one end of the brake means) thereby clamping the rod any freeloop (due to the fact that the brake means do not clamp the rod in the upright position) is avoided. The release means allow to push the brake means into an essentially perpendicular position (against the action of the above-mentioned spring means), thereby releasing the brake means so that the push rod can be pulled back, e.g. for inserting a new cartridge. The release means act simultaneously on the push means and disengage the push rod in order to facilitate the retreat of the push rod.

Upon activation of the lever with one hand, the user can pull back the push rod with the other hand.

In this context it is preferred that a part of the lever is arranged in gripping proximity of the trigger so that it can be activated with a hand which is on the trigger.

The lever can be situated in front and/or above the trigger so that it can be activated by the same hand that activated the trigger.

A further embodiment of the invention is characterized in that the adjusting means are configured as a rotatable wheel with a slope, the rotatable wheel being positioned on the push rod between the stock and the brake means, the distance between the respective contact point of the slope and the brake means defining the retreat of the push rod.

This rotatable wheel which is positioned on the push rod allows the user to select easily and without tools the level of retreat of the push rod by simply turning the wheel between a first position with no retreat of the push rod and a second position with a maximum retreat of the push rod resulting in an anti-drip behaviour of the caulking gun. The brake means are inclined relative to the axis of the push rod. When the highest point of the slope of the rotatable wheel is the closest to the hinge of the brake means, it is in permanent contact with the brake means so that no retreat of the push rod is possible. Upon turning the rotatable wheel, the distance between the highest point of the slope and the brake means can be increased so that the retreat of the push rod is also increased. When the highest point of the slope of the rotatable wheel is the most far away from the hinge of the brake means, the retreat is at its maximum.

The slope can be a continuous slope decreasing from the highest point of the slope to the lowest point thereof, or in form of steps decreasing from the highest point of the slope to the lowest point. The slope can alternatively be configured as at least one knob or a plurality of knobs on the rotatable wheel, the height of the knobs decreasing from one knob to the next one.

An improvement of the invention consists in the fact that the rotatable wheel is provided with a snap defining certain levels of retreat of the push rod.

Such a snap provides the user of the caulking gun with a haptic feedback on the selected adjustment of the retreat of the push rod. A snap can for example define three positions: No retreat, medium retreat and full retreat of the push rod.

In this context, the snap can be realized by an elastic protruding element entering into at least one cavity of the rotatable wheel.

This elastic protruding element can for example be configured as a ball pushed by a spring or an elastic element, both being able to enter into a cavity of the rotatable wheel. The cavity is preferably configured so that with a certain force, the elastic protruding element can be easily pushed out of the cavity when the wheel is turned to another position.

According to the number of snap positions, the rotatable wheel is provided with a corresponding number of cavities which are distributed around the wheel according to the selected snap positions.

In a further preferred embodiment of the invention, the rotatable wheel is provided with visual indicators of the selected retreat of the push rod.

In order to indicate the selected adjustment of the retreat, the current position can be read by the user from the back side of the rotatable wheel which is in the use position of the caulking gun in the visual field of the user of the caulking gun.

The rotatable wheel can be provided with visual indicators of the selected retreat of the push rod.

The wheel can be provided with symbols or words indicating the different positions and a window can be provided for example in the brake means showing the current position.

Figure 2:
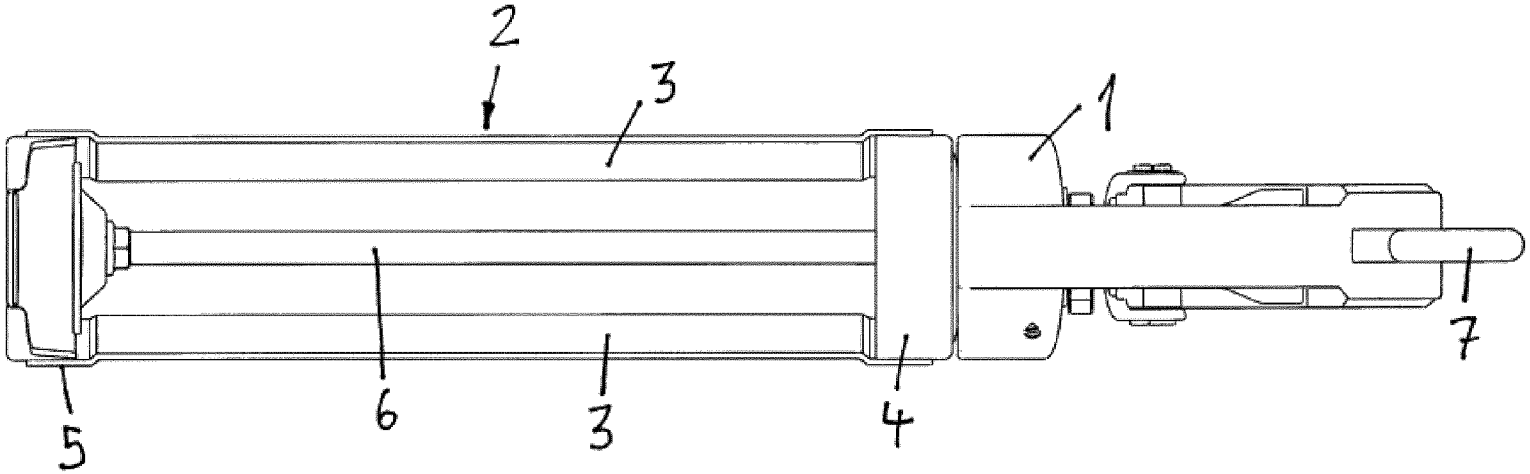
Figure 3:
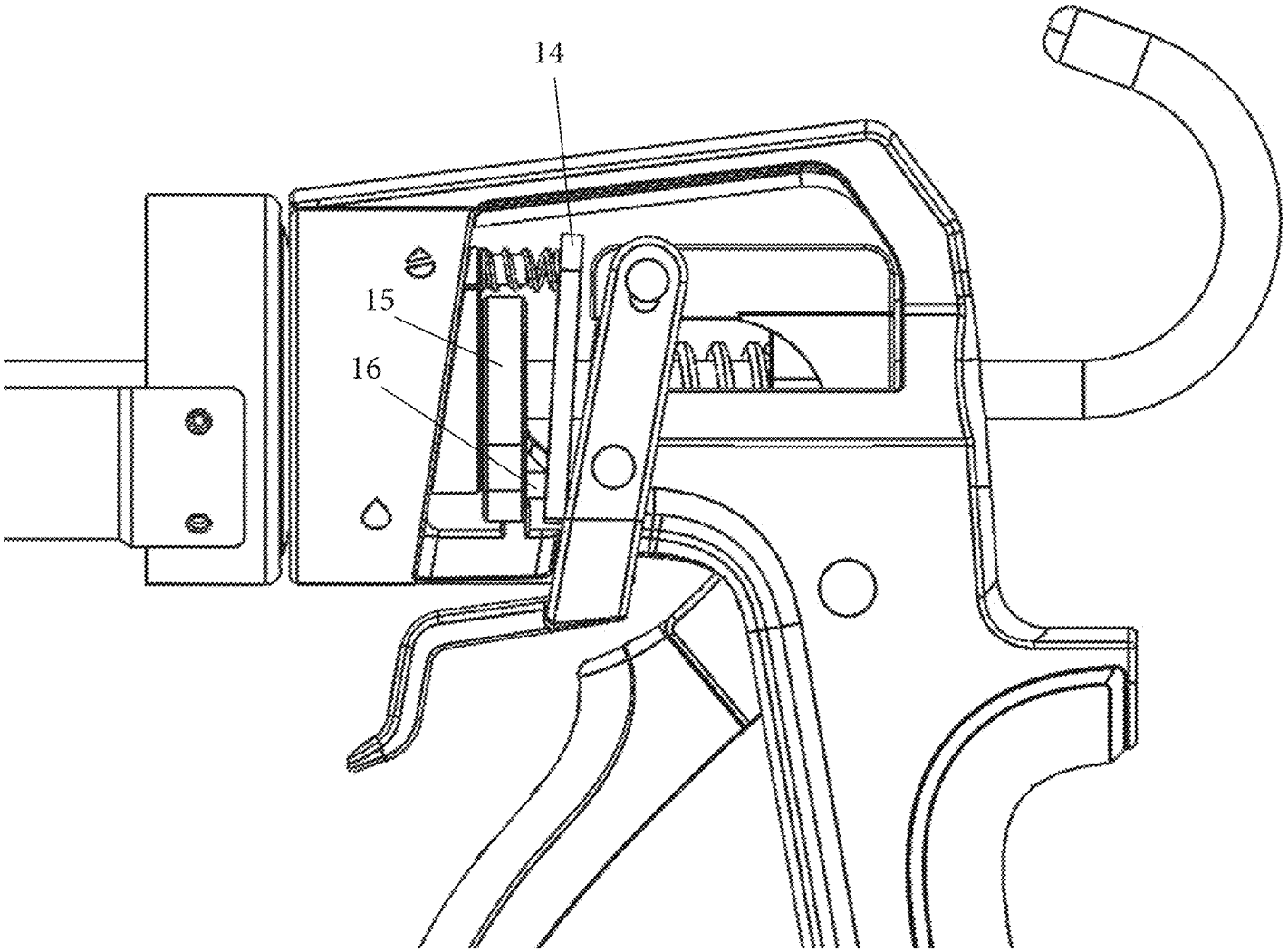
Figure 4:
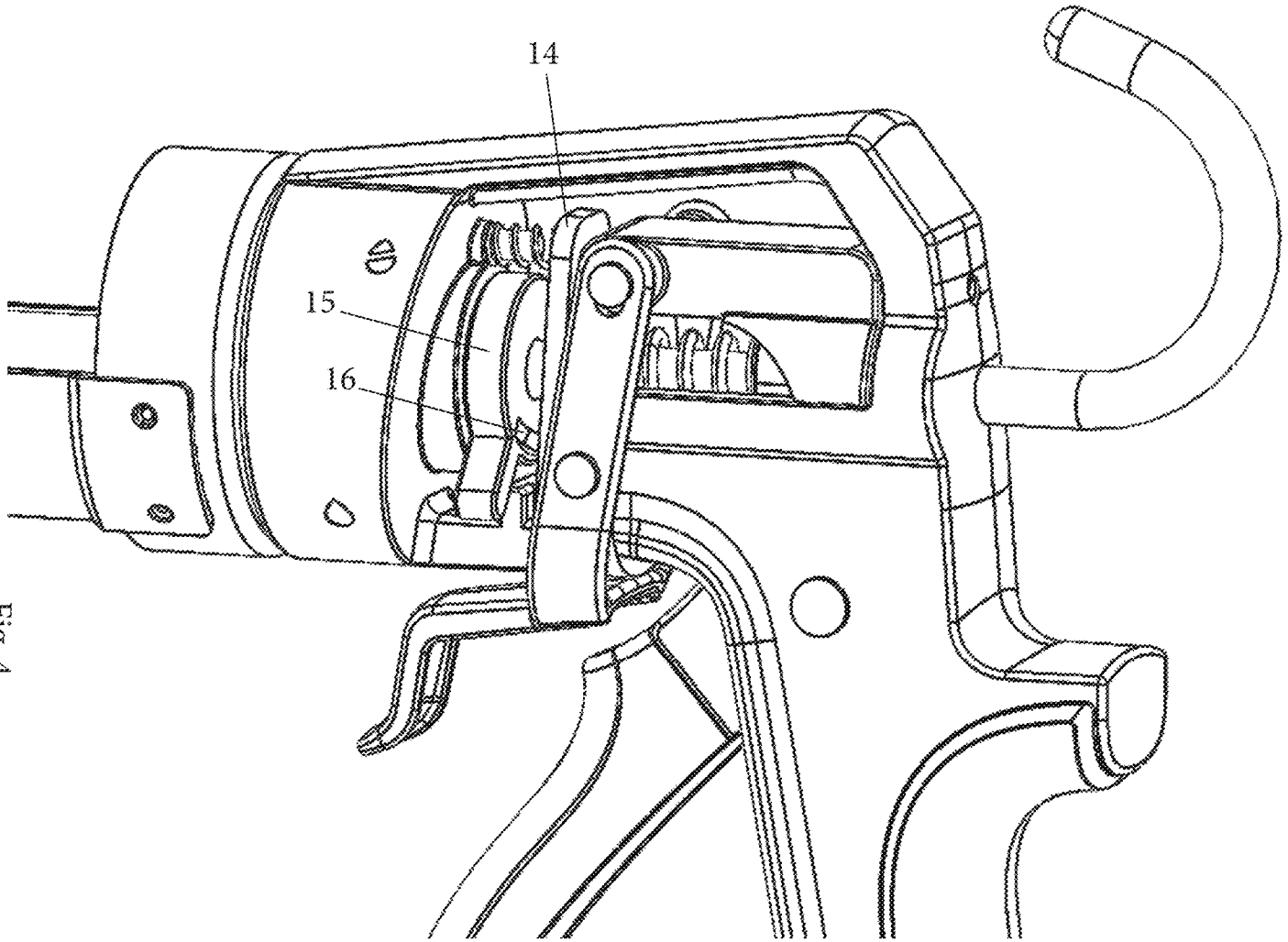
Figure 5:
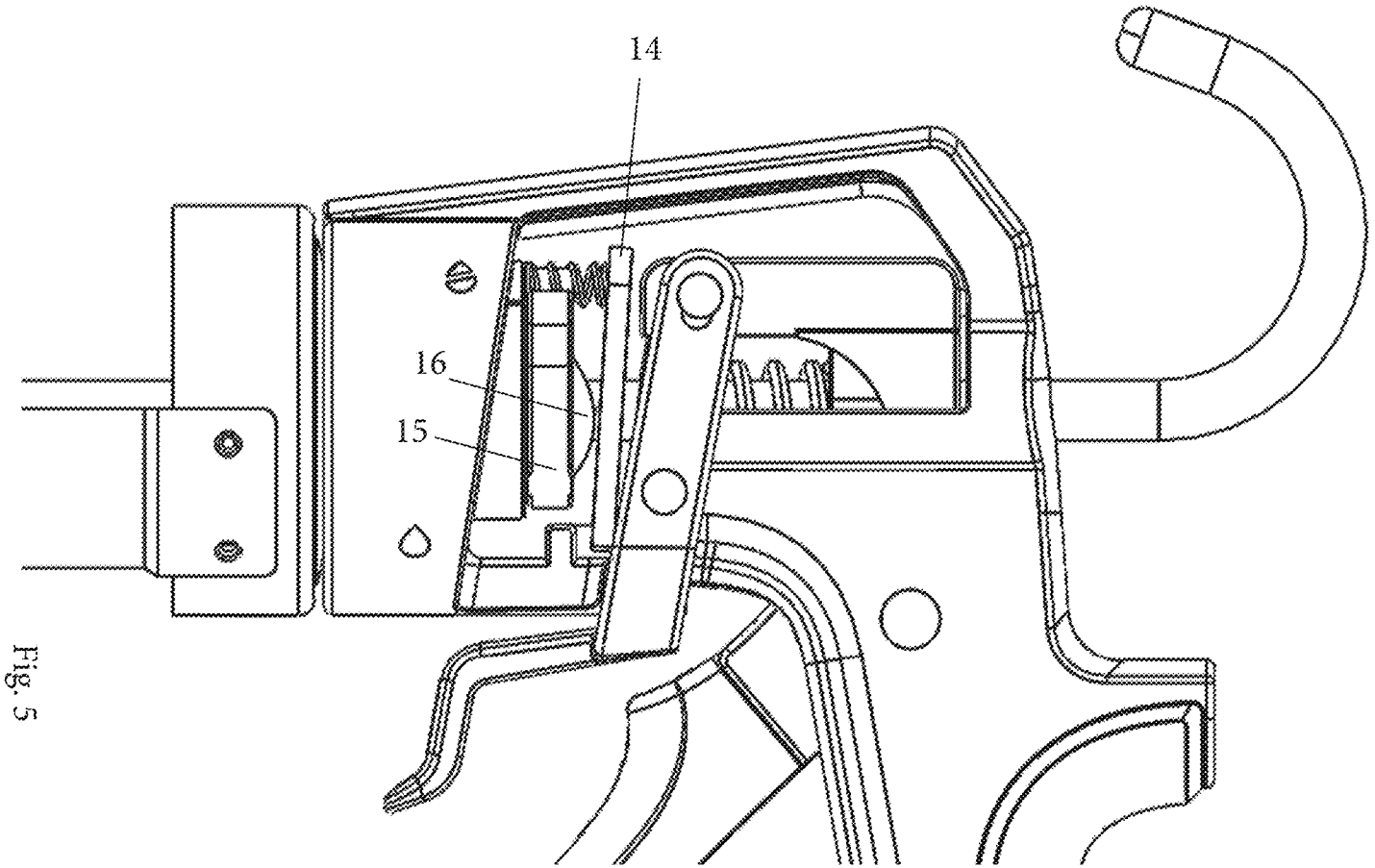
Figure 6:
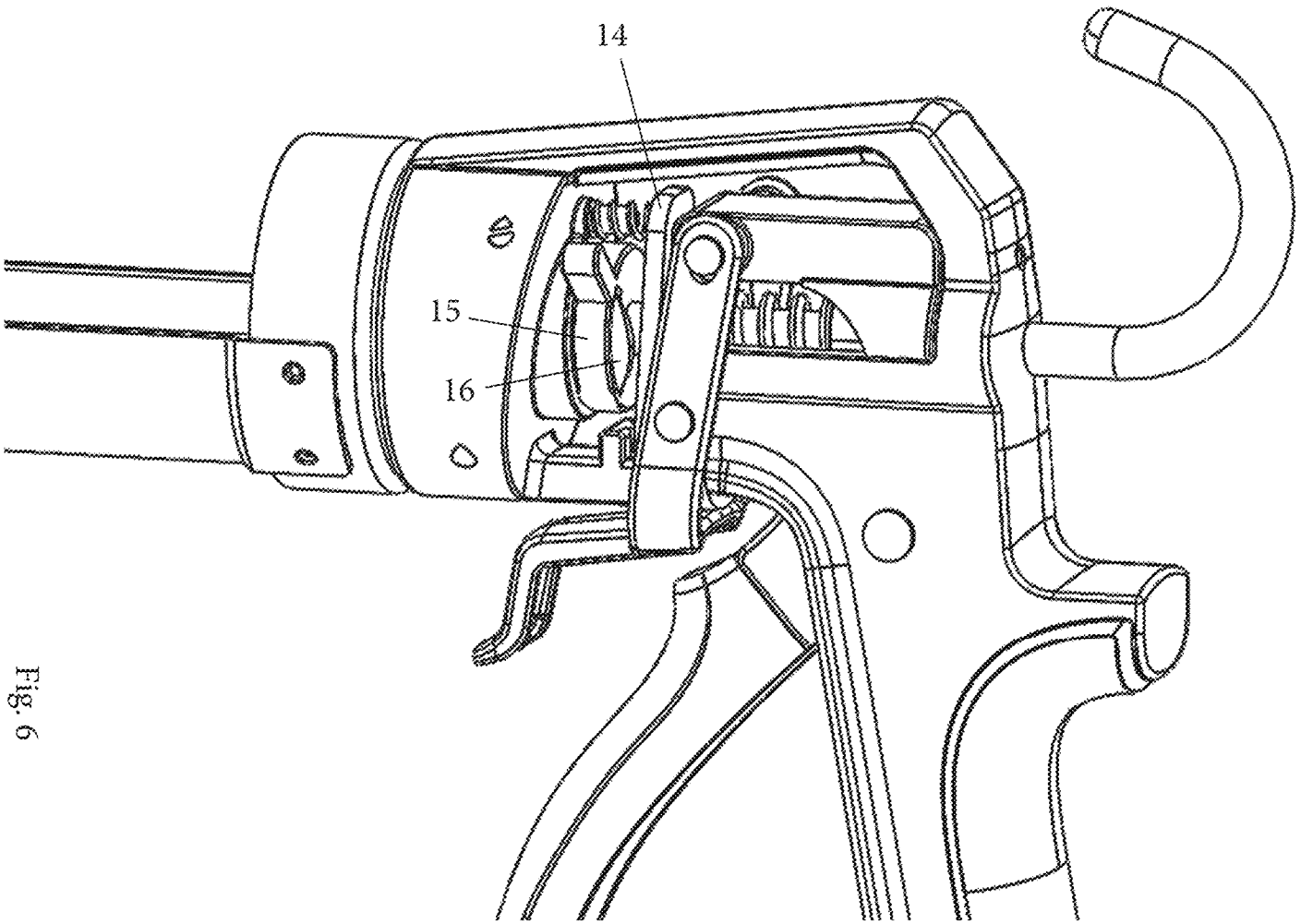
Figure 7:
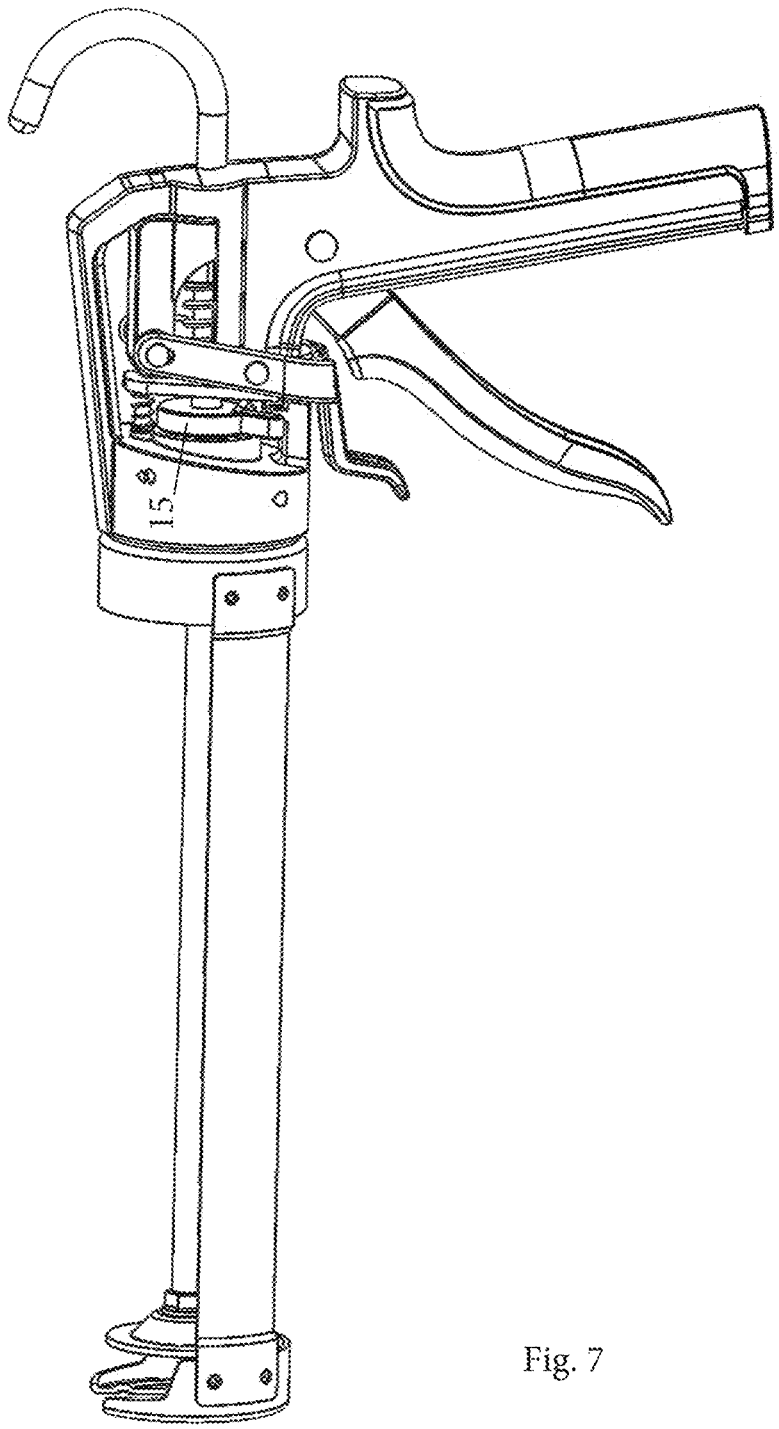
Figure 8:
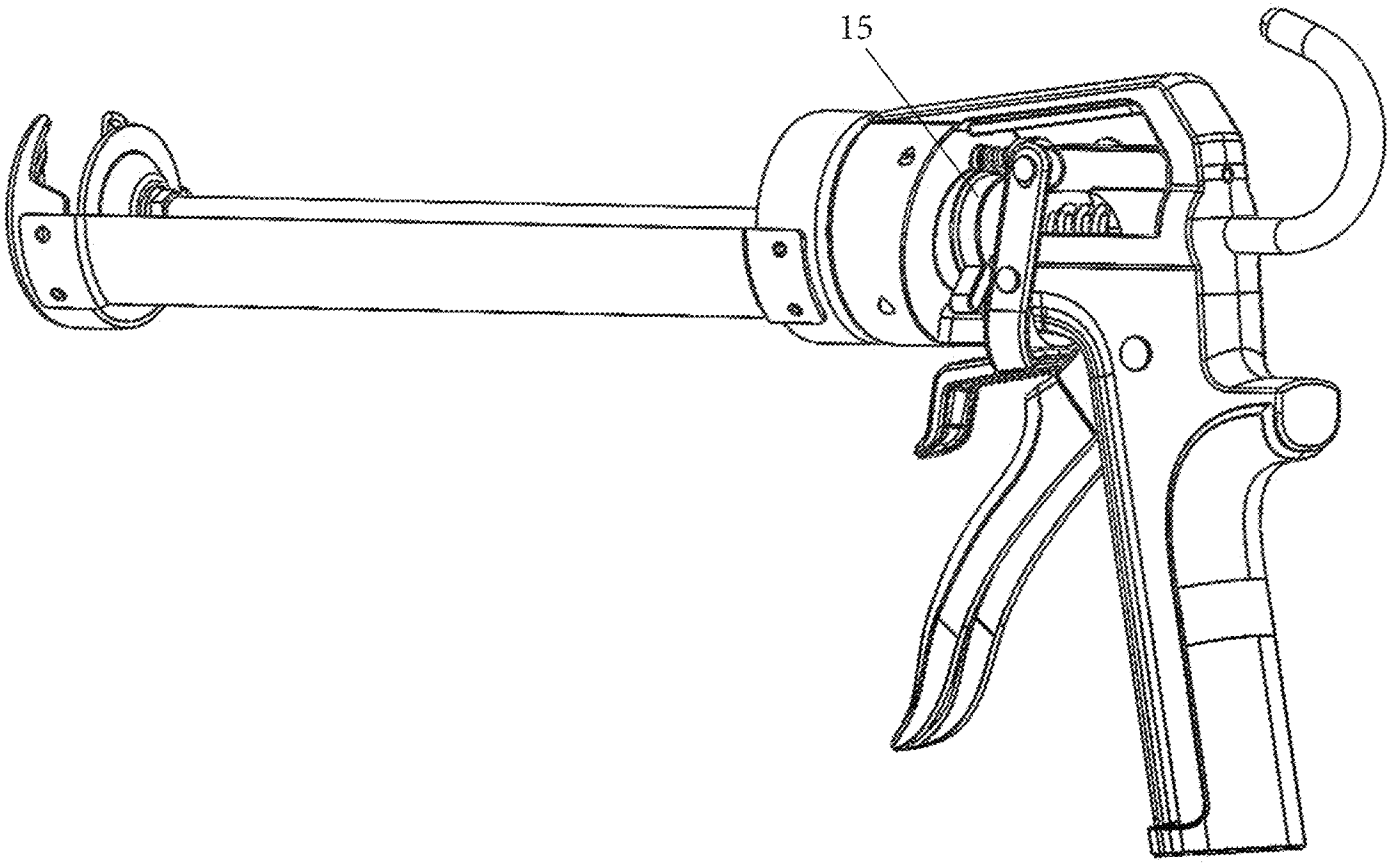
Figure 9:
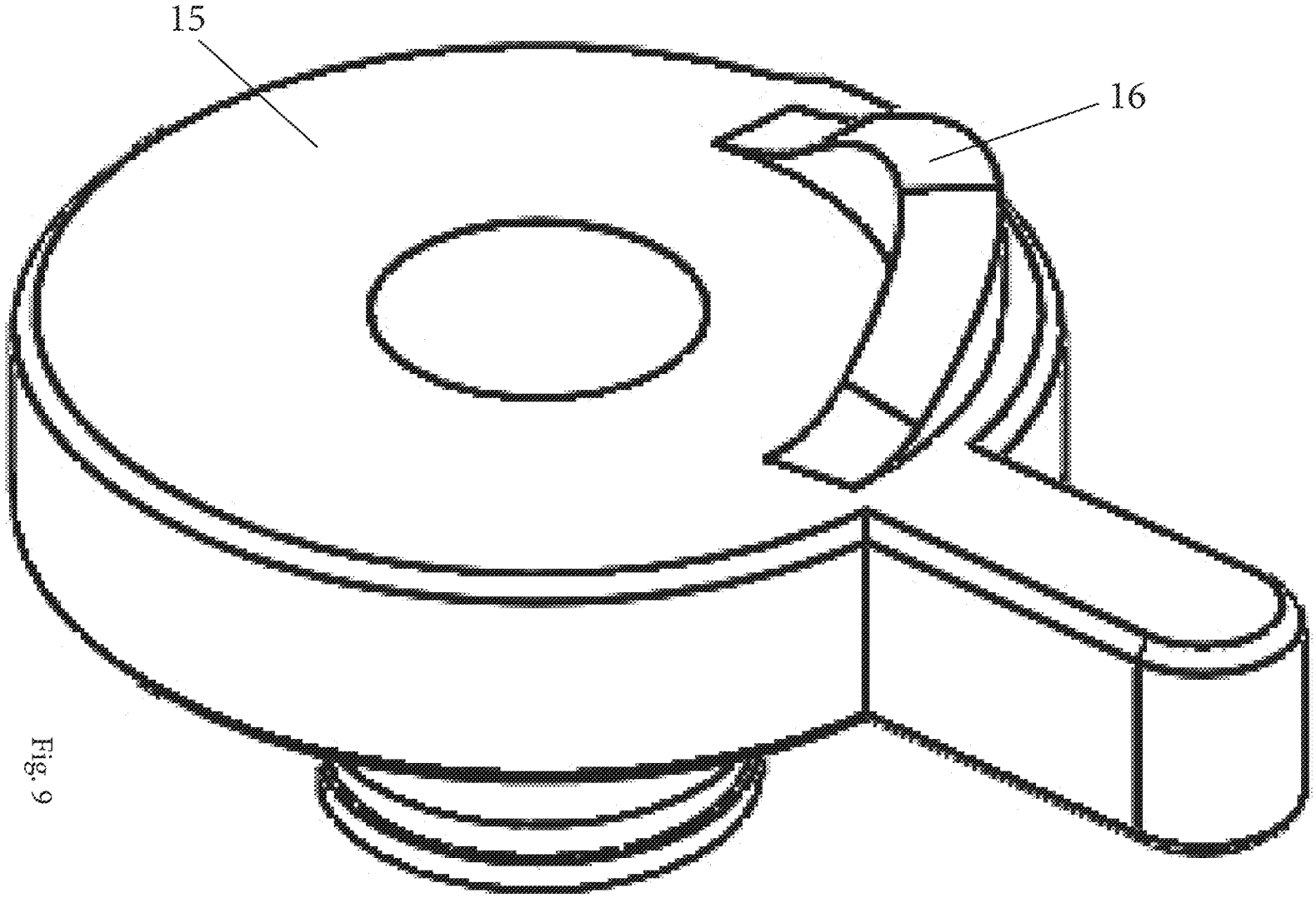
Figure 10:
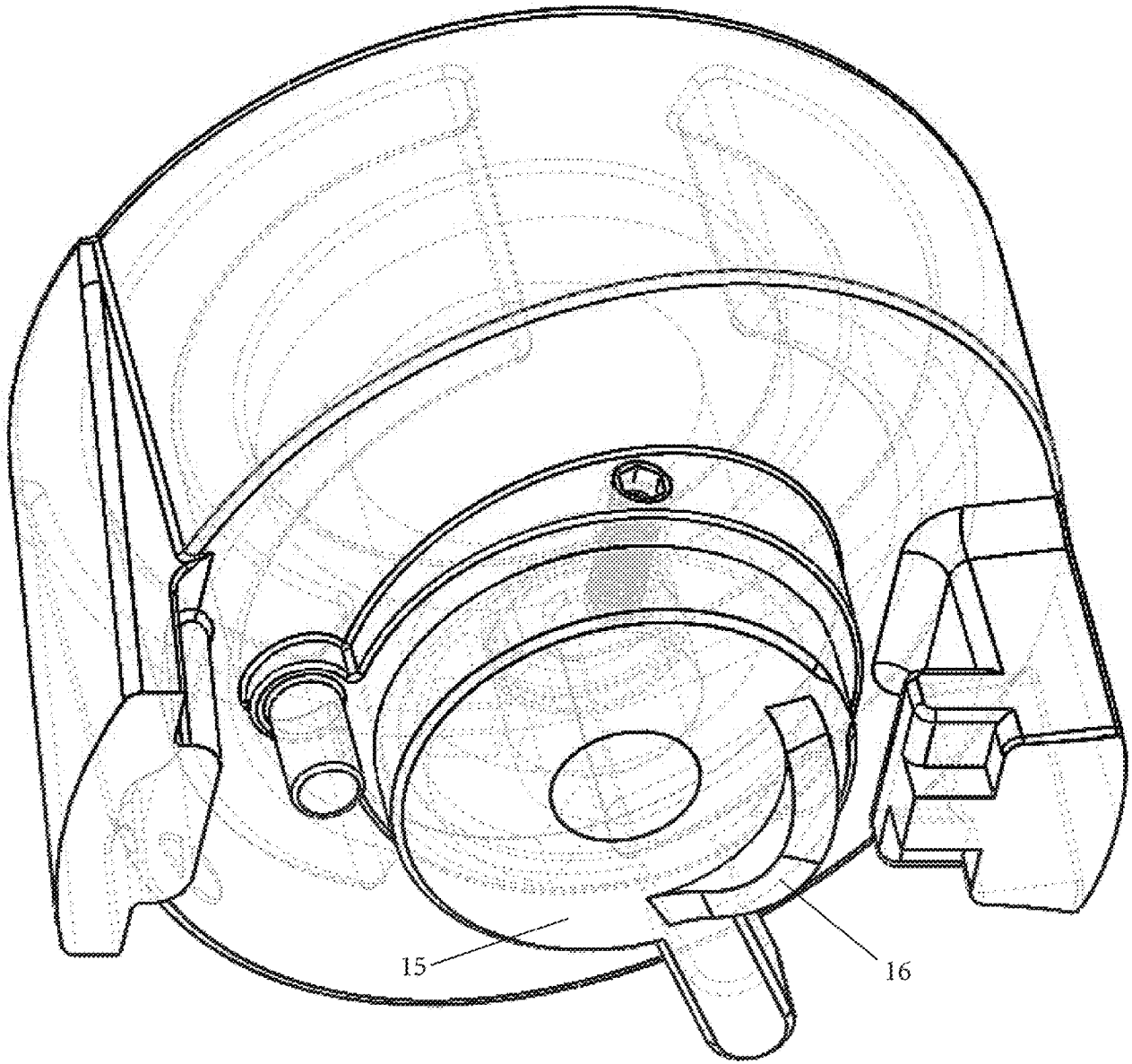
Figure 11:
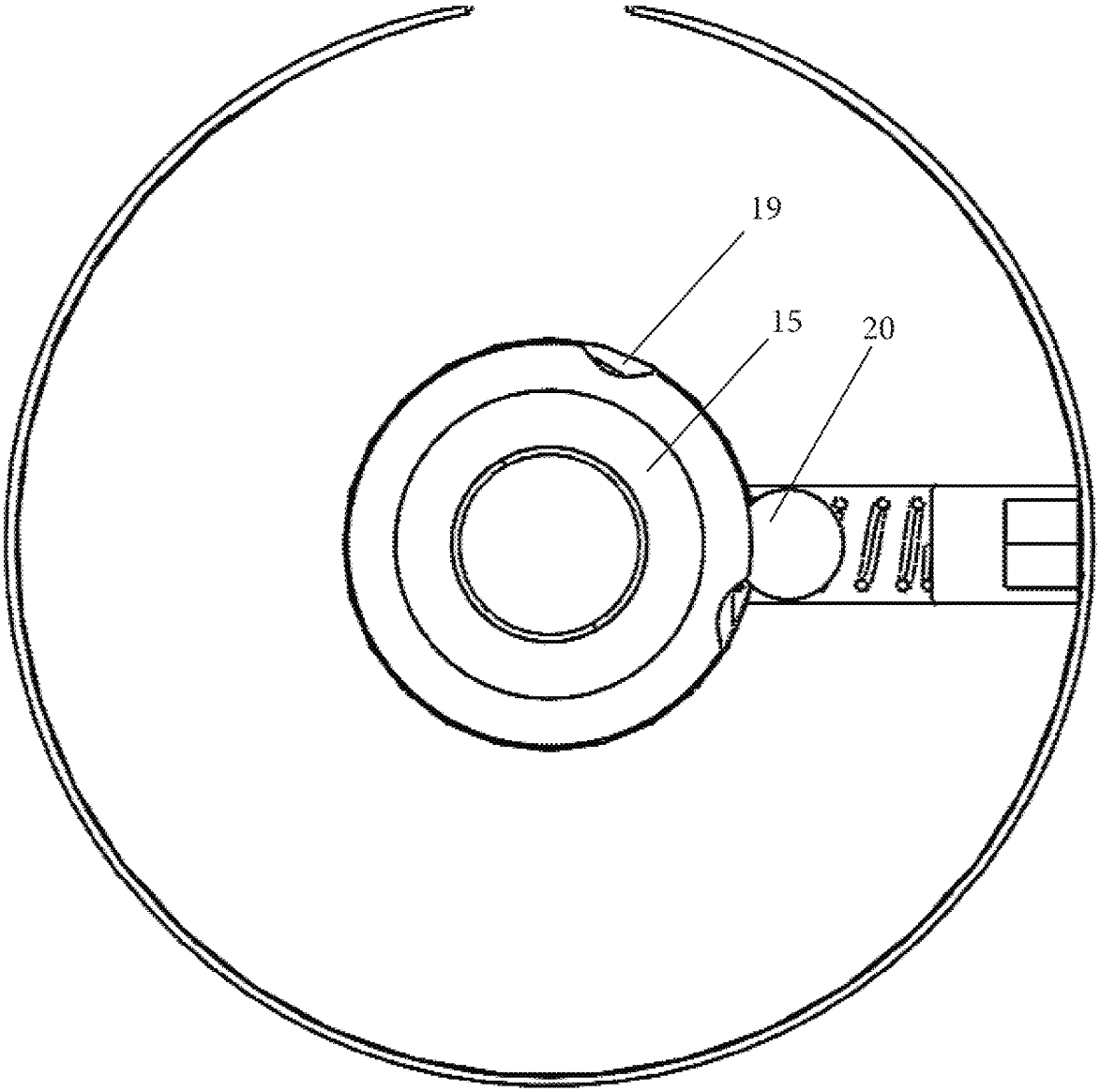
Figure 12:
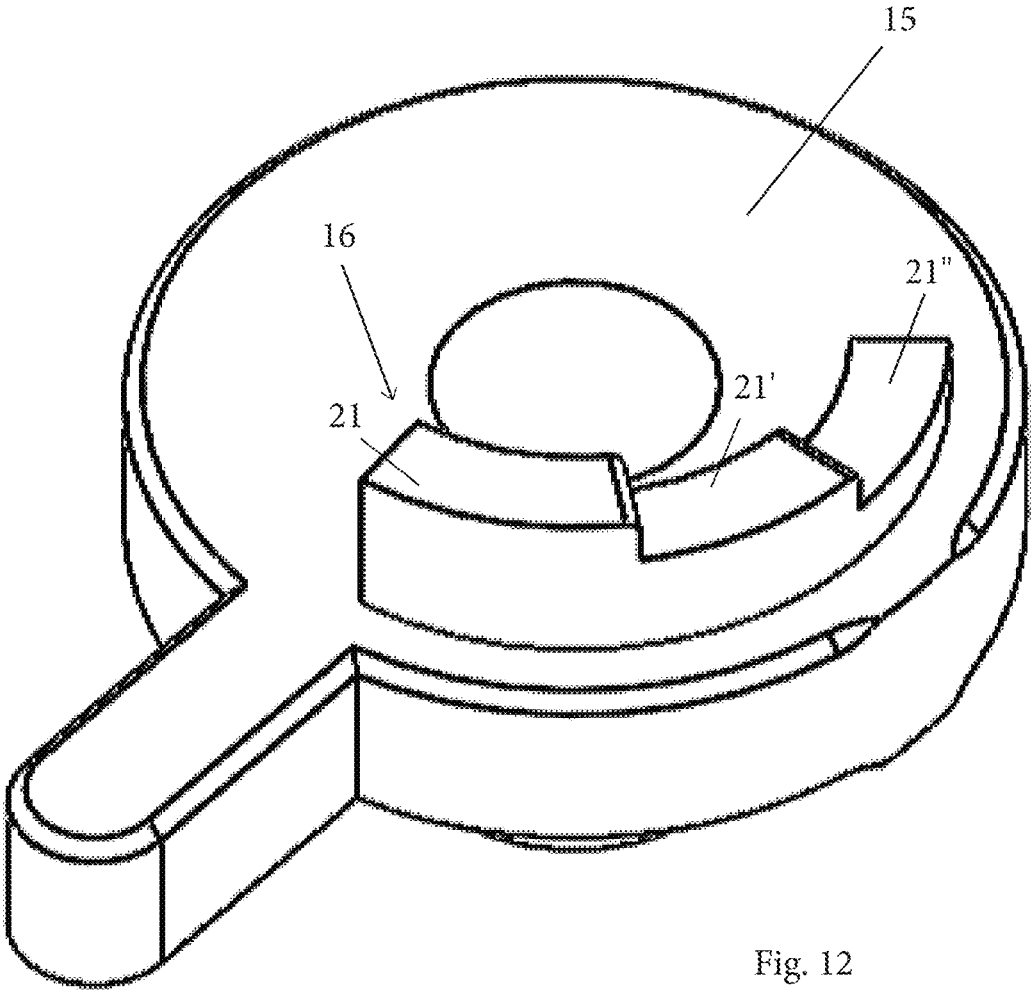

In the following, preferred embodiments of the present invention are shown with reference to the drawing in which FIG. 1 shows a side view of a caulking gun according to the present invention, FIG. 2 shows a top view of a caulking gun according to the present invention, FIG. 3 shows another side view of the stock region of a caulking gun according to the present invention with the rotatable wheel in a first position, FIG. 4 shows another side view of the stock region of a caulking gun according to the present invention with the rotatable wheel in the first position, FIG. 5 shows another side view of the stock region of a caulking gun according to the present invention with the rotatable wheel in a second position, FIG. 6 shows another side view of the stock region of a caulking gun according to the present invention with the rotatable wheel in the second position, FIG. 7 shows another side view of a caulking gun according to the present invention, FIG. 8 shows another side view of a caulking gun according to the present invention, FIG. 9 shows a perspective view of a rotatable wheel used in the present invention, FIG. 10 shows a perspective view of an alternative rotatable wheel used in the present invention, FIG. 11 shows a cross sectional view of the alternative rotatable wheel used in a caulking gun according to the present invention, and FIG. 12 shows a perspective view of another embodiment of a rotatable wheel used in the present invention.

With reference to FIGS. 1 and 2, the caulking gun comprises a stock 1 and a cartridge keep 2. The cartridge keep 2 of the shown example comprises two elongate parallel side frame members 3. One end of each frame member 3 merges with a generally cup-shaped rest 4 secured to the stock 1. The rest 4 bridges the frame members 3 in front of the stock 1.

The opposite ends of the frame members 3 are connected to an annular generally cup-shaped yoke member 5 having a large opening at its base. The rest 4 cooperates with the cup-shaped yoke member 5 to form a cradle for holding the cartridge in position.

A push rod 6 is mounted in the stock 1 for longitudinal movement in a direction parallel to and midway between the two frame members 3. At one end of the push rod 6 there is a plunger which engages the piston of the cartridge. The other end of the push rod 6 is formed as a hook 7 by which the caulking gun may be suspended when it is not in use and which acts as a handle by which the push rod 6 may be moved longitudinally.

The stock 1 is formed with a large central transverse aperture 8. On either side of the aperture 8 there are guide holes which carry the push rod 6. The push rod 6 can be moved incrementally by a mechanism comprising a catch plate 14 in the aperture 8 having an opening through which the push rod 6 extends as a clearance fit.

The push bar 9 is pivotably held between flanks on a trigger 10 and is biased rearwards into an engaged attitude with the push rod 6 via a spring 11. The gush rod 6 can be advanced via the trigger 10 pivoting about a point in the stock 1 defined by a rivet 12. The stock 1 has an integral butt portion 13 which extends downwardly and generally perpendicularly to the axis of the push rod 6. When the trigger 10 is squeezed, the butt portion 13 lies generally within the hollow of the shaped trigger 10.

Brake 14 hinged to the stock 1 and provided with a clearance hole is provided for engaging the push rod 6 such that the push rod 6 is moveable in a direction advancing the push rod 6 towards the cartridge and held in a direction retreating the push rod 6 from the cartridge. The brake 14 is arranged to travel to a first position relative to the stock 1 as the push rod 6 advances and to a second position as the push rod 6 retreats thereby defining the retreat of the push rod 6, the brake 14 being inclined relative to the axis of the push rod 6.

An adjusting device is provided for varying the retreat of the push rod 6. The adjusting device is configured as a rotatable wheel 15 with a slope 16, the rotatable wheel 15 being positioned around the push rod 6 between the stock 1 and the brake 14. The distance between the highest point of the slope 16 and the brake 14 defines the retreat of the push rod 6.

The rotatable wheel 15 with the slope 16 can be turned relative to the push rod 6 and allows the user to select the level of retreat of the push rod 6 by turning the wheel 15 between a first position with no retreat of the push rod 6 (see FIGS. 1 and 3-4) and a second position with a maximum retreat of the push rod 6 (see FIGS. 5-6) resulting in an anti-drip behavior of the caulking gun. When the highest point of the slope 16 of the rotatable wheel 15 is the closest to the hinge of the brake 14, it is in permanent contact with the brake 14 so that no retreat of the push rod 6 is possible. Upon turning the rotatable wheel 15, the distance between the highest point of the slope 16 and the brake 14 can be increased so that the retreat of the push rod 6 is also increased. When the highest point of the slope 16 of the rotatable wheel 15 is the most far away from the hinge of the brake 14, the retreat is at its maximum. FIG. 9 shows an example of an embodiment of a rotatable wheel 15 having a slope 16 that is a continuous slope decreasing from the highest point of the slope to the lowest point thereof.

The rotatable wheel 15 can be provided with visual indicators of the selected retreat of the push rod and the brake 14 can be provided with a window in which the selected retreat is indicated.

According to the present invention, the brake 14 is in the first and in the second position inclined relative to the axis of the push rod 6. Release lever 17 is provided putting the brake 14 in a third, essentially perpendicular position relative to the axis of the push rod is order to disengage the push rod 6 from the brake 14 for pulling back the push rod 6 and for acting simultaneously on the push bar 9 in order to disengage the push rod 6.

In the first and in the second position, spring 18 acting on the upper end of the brake 14 pushes the brake 14 into the oblique (inclined) position relative to the axis of the push rod 6.

The release lever 17 is configured in the shown embodiment as a lever hinged on the stock 1 which is coupled to a back part extending over the spring 11 and ending behind the push bar 9. When the release lever 17 is activated, it pushes one end (in the shown embodiment: the upper end) of the brake 14 against the effect of the spring 18 from the inclined position to the essentially perpendicular position in which the push rod 6 can be pulled back. Simultaneously, the back part of the release lever 17 acts on the push bar 9 pushing it towards the front end of the caulking gun thereby disengaging the push rod 6 in order to facilitate the retreat of the push rod 6.

When the release lever 17 is no longer activated, the brake 14 returns automatically into the inclined position.

The lower part of the lever is arranged in gripping proximity of the trigger 10 so that it can be activated with a hand which is on the trigger 10.

FIGS. 10 and 11 show another embodiment of a rotatable wheel 15 which includes a snap realized by an elastic protruding element 20. The elastic protruding element 20 enters into a cavity 19 of the rotatable wheel 15. The rotatable wheel 15 includes multiple cavities 19 distributed around the wheel 15 according to selected positions of the elastic protruding element 20.

FIG. 12 shows another embodiment of a rotatable wheel 15 in which the slope 16 is in the form of steps 21, 21', and 21" decreasing from the highest point 21 of the slope 16 to the lowest point 21".

The invention claimed is:

1. A caulking gun for dispensing viscous material, the caulking gun comprising:

a stock formed with a central transverse aperture;

a cartridge keep;

a push rod longitudinally moveably mounted in the stock provided at its one end with a plunger which engages the piston of a cartridge placed in the cartridge keep;

a bar for engaging the push rod to advance it, the bar being pivotably held between flanks on a trigger and being biased rearwards into an engaged attitude with the push rod via a spring;

the trigger being coupled to the bar;

a brake hinged to the stock and provided with a clearance hole for engaging the push rod such that the push rod is moveable in a direction advancing the push rod towards the cartridge and is held in a direction retreating the push rod from the cartridge, wherein the brake is arranged to travel to a first position relative to the stock as the push rod advances and to a second position as the push rod retreats thereby defining the retreat of the push rod, wherein the brake is in the first and in the second position inclined relative to the axis of the push rod and wherein a lever is provided for pushing the brake in a third, essentially perpendicular position relative to the axis of the push rod in order to disengage the push rod from the brake for pulling back the push rod and for acting simultaneously on the bar in order to disengage the push rod; and a wheel arranged for varying the retreat of the push rod;

wherein the lever is coupled to a back part extending over the spring and ending behind the bar, which when it is activated pushes one end of the brake from the inclined position to the essentially perpendicular position in which the push rod can be pulled back and acts simultaneously on the bar in order to disengage the push rod, wherein the wheel, the brake and the lever are arranged in the central traverse aperture of the stock above the trigger.

2. The caulking gun according to claim 1, wherein a part of the lever is arranged in gripping proximity of the trigger so that it can be activated with a hand which is on the trigger.

3. The caulking gun according to claim 1, wherein the wheel is a rotatable wheel with a slope, the rotatable wheel being positioned on the push rod between the stock and the brake, the distance between the respective contact point of the slope and the brake defining the retreat of the push rod.

4. The caulking gun according to claim 3, wherein the slope is a continuous slope decreasing from the highest point of the slope to the lowest point thereof.

5. The caulking gun according to claim 3, wherein the slope is in form of steps decreasing from the highest point of the slope to the lowest point thereof.

6. The caulking gun according to claim 3, wherein the rotatable wheel is provided with at least one snap defining certain levels of retreat of the push rod.

7. The caulking gun according to claim 6, wherein the snap is realized as an elastic protruding element entering into at least one cavity of the rotatable wheel.

8. The caulking gun according to claim 6, wherein the rotatable wheel is provided with a corresponding number of cavities which are distributed around the rotatable wheel according to selected positions of the snap.

9. The caulking gun according to claim 3, wherein the wheel is rotatable and is provided with visual indicators of a selected retreat of the push rod.

* * * * *